US011891865B1

(12) United States Patent
Xu et al.

(10) Patent No.: US 11,891,865 B1
(45) Date of Patent: Feb. 6, 2024

(54) FULL-FACE SHAFT TUNNEL BORING MACHINE SYSTEM

(71) Applicants: HEFEI DESIGN & RESEARCH INSTITUTE OF COAL INDUSTRY CO., LTD, Hefei (CN); UNIVERSITY OF SCIENCE AND TECHNOLOGY BEIJING, Beijing (CN); CHINA COAL NO. 3 CONSTRUCTION CORPORATION (GROUP) LTD, Hefei (CN); ANSTEEL GROUP MINING CORPORTION LIMITED, Anshan (CN)

(72) Inventors: Huidong Xu, Hefei (CN); Renshu Yang, Hefei (CN); Bin Xu, Hefei (CN); Ning Liu, Hefei (CN); Guang Li, Hefei (CN); Yong Zhang, Hefei (CN); Jinghui Ye, Hefei (CN); Lin Lv, Hefei (CN); Fei Ma, Hefei (CN); Donghui Man, Hefei (CN); Tingting Bao, Hefei (CN); Zheng Li, Hefei (CN); Yingcan Liu, Hefei (CN); Guozheng Zhou, Hefei (CN); Bo Ding, Hefei (CN)

(73) Assignees: HEFEI DESIGN & RESEARCH INSTITUTE OF COAL INDUSTRY CO., LTD, Hefei (CN); UNIVERSITY OF SCIENCE AND TECHNOLOGY BEIJING, Beijing (CN); CHINA COAL NO.3 CONSTRUCTION CORPORATION (GROUP) LTD, Hefei (CN); ANSTEEL GROUP MINING CORPORATION LIMITED, Anshan (CN)

( * ) Notice: Subject to any disclaimer, the term of this patent is extended or adjusted under 35 U.S.C. 154(b) by 0 days.

(21) Appl. No.: 18/455,878

(22) Filed: Aug. 25, 2023

Related U.S. Application Data

(63) Continuation of application No. PCT/CN2023/083992, filed on Mar. 27, 2023.

(30) Foreign Application Priority Data

Aug. 25, 2022 (CN) ..... 202211024631.8

(51) Int. Cl.
*E21B 21/00* (2006.01)
*E21D 1/06* (2006.01)
*E21D 5/00* (2006.01)

(52) U.S. Cl.
CPC ..... *E21B 21/002* (2013.01); *E21D 1/06* (2013.01); *E21D 5/00* (2013.01)

(58) Field of Classification Search
CPC .... E21D 1/06; E21D 5/04; E21D 5/06; E21D 5/00; E21D 5/11
See application file for complete search history.

(56) References Cited

U.S. PATENT DOCUMENTS

2020/0018163 A1* 1/2020 Jordaan ..... E21D 1/06

FOREIGN PATENT DOCUMENTS

CN 103670420 A 3/2014
CN 103850686 A 6/2014
(Continued)

OTHER PUBLICATIONS

First Office Action issued in counterpart Chinese Patent Application No. 202211024631.8, dated Apr. 27, 2023.
(Continued)

*Primary Examiner* — Robert E Fuller
(74) *Attorney, Agent, or Firm* — Westbridge IP LLC

(57) ABSTRACT

A full-face shaft tunnel boring machine system includes a tunnel boring machine cutterhead device for tunneling
(Continued)

downwards in a shaft; a full-hydraulic formwork device for supporting and walling in a wellbore; and an upper muck-discharge system for vertically conveying rock mucks generated by tunneling. The tunnel boring machine cutterhead device comprises a vertical guide frame, a cutter-expanded boring head and an advanced cutterhead that are fixedly connected in a vertical order from top to bottom so as to form an integrated structure. The vertical guide frame is a hollow cylindrical structure and driven to rotate around an axis of the vertical guide frame by a power mechanism, and an outer wall of the vertical guide frame is provided with multiple sets of first guide rollers.

9 Claims, 18 Drawing Sheets

(56) References Cited

FOREIGN PATENT DOCUMENTS

| | | | |
|---|---|---|---|
| CN | 105156112 | A | 12/2015 |
| CN | 208950298 | U | 6/2019 |
| CN | 111852481 | A | 10/2020 |
| CN | 212406721 | U | 1/2021 |
| CN | 113503162 | A | 10/2021 |
| CN | 216922116 | U | 7/2022 |
| CN | 114909139 | A | 8/2022 |
| CN | 115288697 | A | 11/2022 |
| JP | 2004332487 | A | 11/2004 |
| RU | 2060394 | C1 | 5/1996 |
| WO | 2017058058 | A1 | 4/2017 |

OTHER PUBLICATIONS

International Search Report and Written Opinion issued in corresponding PCT Application No. PCT/CN2023/083992, dated May 23, 2023.

Second Office Action issued in counterpart Chinese Patent Application No. 202211024631.8, dated Jun. 15, 2023.

* cited by examiner

FULL-FACE SHAFT TUNNEL BORING MACHINE SYSTEM

CROSS-REFERENCE TO RELATED APPLICATION

This application is a continuation application of International Application No. PCT/CN2023/083992, filed on Mar. 27, 2023, which claims priority to Chinese Patent Application No. 202211024631.8, filed on Aug. 25, 2022. The disclosures of the above-mentioned applications are incorporated herein by reference in their entireties.

TECHNICAL FIELD

The present disclosure relates to a full-face shaft tunnel boring machine system, belonging to the technical field of underground engineering construction.

BACKGROUND

Full-face shaft mechanized rock-breaking and muck-discharge equipment is a key technical problem that has not yet resolved in shaft construction at home and abroad. All cutterheads used in traffic, water conservancy, mines and other drifts and tunnels adopt a plane structure, which has a better tunneling and rock-breaking effect on the drifts, while the cutterhead in shaft equipment mostly adopts a plane structure or a conical structure, so the cutterhead has the following problems.

Firstly, although the cutterhead adopting the plane structure runs stably and is not easy to deflect, the shaft has a great tunneling face, and a bottom of the shaft is also a plane structure, which has no muck gathering space, and rock mucks sinking to a bottom under a self-gravity action not only causes the cutterhead to regrind the rock mucks, but also is hard to discharge the rock mucks, the efficiency is low, and the cutterhead and the cutter are seriously worn.

Secondly, although the crushed rock mucks are easy to slide down and gather along a tilted surface if the conical structure is adopted, a majority of stratum is tilted, easily causing wellbore deflection, which is hard to be corrected; and moreover a middle has no rock muck gathering space, which causes difficult muck discharge and poor effect.

Then, a walling formwork used by a traditional blasting method is designed as a single-seam formwork, in a middle of which a movable board is arranged, easily causing difficult formwork removal; the formed wellbore has uneven roundness, and the formwork is all suspended on the ground with a winch, which occupies a lot of equipment and steel wire ropes and processes a higher cost; and the mechanized rock-breaking construction wellbore of the tunnel boring machine is not yet equipped with a fast and safe walling formwork system.

Again, the muck discharge is a technical problem in the construction of the full-face deep-shaft tunnel boring machine, which will cause a low deep-shaft construction efficiency, and the traditional muck-discharge mode I is a mud circulation muck-discharge mode. This mode adopts a certain ratio of mud to coerce the rock mucks to be hoisted and transported by a mud pump, and afterwards the mud returns to a working face for recycling. The mud may be directly conveyed to the ground in a shallow shaft (100 m); and multiple sets of relay stations need to be set in a middle shaft and a deep shaft for conveying the mud to the ground continuously. This mode I has the shortcomings of low mud circulation efficiency, high energy consumption, easy tube plugging caused by large-scale rock mucks, high fault rate, limited wellbore space, difficult setting for the relay stations and poor reliability. The mud is hard to conform to environmental protection requirements due to being added with a plurality of chemical agents.

The traditional muck-discharge mode II is a mode of combining a primary muck-discharge pump with a secondary hoist bucket. A water-muck separating device needs to be set on a hanging scaffold, the water and the rock mucks are conveyed into the water-muck separating device on the hanging scaffold in a short distance, and the rock mucks upon separation are conveyed to the ground through the winch driving the bucket. This mode II has the shortcomings of bucket transportation being hard to achieve process automation, multiple integral links, complex process, multiple equipment, discontinuity, low muck-discharge efficiency and high energy consumption.

SUMMARY

In order to overcome the defects in the prior art, the objective of the present disclosure is to provide a full-face shaft tunnel boring machine system, and this system is provided with a tunnel boring machine cutterhead device with a brand new structure, a full-hydraulic formwork device and an upper muck-discharge system and method overturning the traditional mode, in order to effectively solve the shortcomings of the existing problems.

The technical solution adopted to solve the technical problem in the present disclosure is as follows.

A full-face shaft tunnel boring machine system, including:

a tunnel boring machine cutterhead device for tunneling downwards in a shaft;

a full-hydraulic formwork device for supporting and walling in a wellbore; and an upper muck-discharge system for vertically conveying rock mucks generated by tunneling;

the tunnel boring machine cutterhead device includes a vertical guide frame, a cutter-expanded boring head and an advanced cutterhead that are fixedly connected from top to bottom so as to form an integrated structure;

the vertical guide frame is a hollow cylindrical structure and driven to rotate around a self-axis by a power mechanism, and an outer wall of the vertical guide frame is provided with multiple sets of first guide rollers;

the cutter-expanded boring head is a hollow cone-shaped structure, and an outer wall of the cutter-expanded boring head is provided with multiple sets of first hobbing cutters and first scrapers, first muck outlets and water holes;

the advanced cutterhead is a hollow cylindrical structure, a circumferential surface of an outer wall of the advanced cutterhead is provided with multiple sets of second guide rollers, and a bottom of the advanced cutterhead is provided with multiple sets of second hobbing cutters and second scrapers, second muck outlets and water holes;

a primary muck-discharge pump is arranged in an inner cavity of the advanced cutterhead;

the full-hydraulic formwork device includes an outer formwork, an inner formwork, a formwork support structure and formwork guide and moving assemblies;

the formwork support structure is a cylindrical profile steel composite structure and suspended on a lower part of a hanging scaffold that is on an upper part of the formwork support structure;

one end of each formwork guide and moving assembly is connected to the formwork support structure while the other end is connected to the formwork, and the formwork guide and moving assemblies can stretch in order to achieve a radial horizontal displacement of the formwork in the wellbore;

the upper muck-discharge system includes a primary muck-discharge unit, a secondary muck-discharge unit and a control system;

the primary muck-discharge unit includes a primary muck-discharge pump and a primary muck-discharge pipeline, the primary muck-discharge pump is arranged in the inner cavity of the advanced cutterhead, and multi-scale rock mucks and water are discharged upwards to the secondary muck-discharge unit through the primary muck-discharge pipeline;

the secondary muck-discharge unit includes water-muck separating equipment, crushing equipment, grinding equipment, a muck slurry bin and a secondary muck-discharge pump which are arranged from top to bottom;

an inlet of the water-muck separating equipment communicates with the primary muck-discharge pipeline, a rock muck outlet communicates to the crushing equipment, and water, and a fine muck outlet less than 0.4 mm communicate to the muck slurry bin;

an inlet of the grinding equipment communicates with the rock muck outlet of the water-muck separating equipment, and an outlet of the grinding equipment communicates with the muck slurry bin; and a muck slurry in the muck slurry bin is pumped to the ground through the secondary muck-discharge pump.

More preferably, the first guide rollers are distributed at intervals along an axis direction of the vertical guide frame so as to constitute one row from top to bottom, and multiple rows of rollers are arranged at equal intervals along a circumferential direction of the vertical guide frame.

More preferably, on a circumferential surface of the advanced cutterhead, the second guide rollers are distributed at intervals along an axis of the advanced cutterhead so as to constitute one row from top to bottom, and multiple rows of rollers are arranged at equal intervals along a circumferential direction of the advanced cutterhead.

More preferably, on a side of the cutter-expanded boring head, the first hobbing cutters and the first scrapers are distributed at intervals along a slant height of a cone, multiple first hobbing cutters and multiple first scrapers are each distributed in a row, multiple first hobbing cutters and multiple first scrapers are distributed at equal intervals on the side of the cutter-expanded boring head along the circumferential direction of the cone, and a first muck outlet is disposed between any two adjacent rows of first scrapers.

More preferably, two rows of first scrapers and one row of first hobbing cutters constitute a group of rock-breaking and muck-shoveling system, multiple groups of rock-breaking and muck-shoveling systems are distributed at equal intervals on the side of the cutter-expanded boring head along the circumferential direction, the first muck outlet is disposed between two adjacent rock-breaking and muck-shoveling systems, and one row of the first hobbing cutters is located between the two rows of first scrapers, in any one group of rock-breaking and muck-shoveling systems.

More preferably, the cutter-expanded boring head is a hollow cone, and an included angle between the axis of the cone and the slant height is 15-75 degrees.

More preferably, the included angle between the axis of the cone and the slant height is 25-65 degrees.

More preferably, at least one row of second hobbing cutters, and two rows of second scrapers that are located on both sides of the second hobbing cutters are arranged on a bottom face of the advanced cutterhead; and second muck outlets and the rowed second robs/second scrapers are crossly arranged in the circumferential direction of the advanced cutterhead.

More preferably, the vertical guide frame and the advanced cutterhead are both hollow cylindrical structures, and a diameter ratio of the advanced cutterhead to the vertical guide frame is 1:2-1:6 (certainly, the ratio may also be a little bit smaller according to actual construction demands).

More preferably, the diameter ratio of the advanced cutterhead to the vertical guide frame is 1:3-1:5 (certainly, the ratio may also be a little bit smaller according to actual construction demands).

More preferably, the shaft walling full-hydraulic formwork device further includes a formwork positioning assembly, which includes a steel structure support beam connected to the inner formwork and the outer formwork in a vertical direction, and a telescopic oil cylinder connected to the support beam; the telescopic oil cylinder is disposed along a horizontal direction, an upper end and a lower end of each group of inner formwork and outer formwork are each provided with at least one group of telescopic oil cylinders, an inner side end of each telescopic oil cylinder is connected to the support beam while an outer side end is provided with a supporting shoe, the supporting shoe of the telescopic oil cylinder at the lower end of the formwork contacts with a tunneling rock shaft wall, and the supporting shoe of the telescopic oil cylinder at the upper end of the formwork contacts with a poured concrete shaft wall.

More preferably, a plurality of suspending points are uniformly distributed around an exterior of the formwork support structure, and suspended at the lower part of the hanging scaffold that is at the upper part of the formwork support structure through the steel wire ropes; and a cross section of the formwork support structure is square, and outer walls of the four sides of the formwork support structure are all connected to the formwork guide and moving assemblies.

More preferably, each formwork guide and moving assembly is a double-layer cylindrical steel structure, an inner cylinder and an outer cylinder are sleeved and can displace relatively along an axis, an end part of the outer cylinder is connected to the formwork support structure through a first flange, and an end part of the inner cylinder is connected to an inner formwork and an outer formwork through a second flange; and at least two groups of hydraulic oil cylinders are disposed outside the outer cylinder, and two ends of the hydraulic oil cylinders are connected to the first flange and the second flange, respectively.

More preferably, the outer formwork is an arc-shaped steel structure, of which an outer side is a steel plate and an inner side is a profile steel composite structure, two ends of the outer formwork are tilted surface structures, and an included angle $\alpha$ between the tilted surface and the outer side is 15-45 degrees, preferably 25-45 degrees. A central angle of an outer arc $\varphi 2$ is greater than a central angle of an inner arc $\varphi 1$.

More preferably, the inner formwork is an arc-shaped steel structure, of which an outer side is a steel plate and an inner side is a profile steel composite structure, two ends of the inner formwork are tilted surface structures, and an included angle $\beta$ between the tilted surface and the inner side is 15-45 degrees, preferably 25-45 degrees. A central angle of an outer arc φ2 is less than a central angle of an inner arc φ1.

More preferably, a settling pond is disposed on the ground, the secondary muck-discharge pipeline of the secondary muck-discharge pump communicates with the settling pond, partitions "are disposed in the settling pond, and after the partitions, clear water returns to the tunneling working face through a water return pipeline for recycling.

More preferably, the muck slurry bin further communicates with a water supply pipe, and a stirring device, a high-level sensor, a low-level sensor and a muck slurry concentration sensor are also disposed in the muck slurry bin; and each sensor and an electromagnetic valve for controlling the water supply pipe to be opened and closed are both electrically connected to the control system.

More preferably, in the water-muck separating equipment, the rock muck with a granularity of less than or equal to 0.4 mm directly enters the muck slurry bin together with the water through the pipeline.

More preferably, in the crushing equipment, the crushed rock muck with a granularity of less than 8 mm enters the grinding equipment.

More preferably, in the grinding equipment, the ground rock muck with a granularity of less than 0.4 mm enters the muck slurry bin, and the muck slurry, formed after being stirred, is pumped to the settling pond through the secondary muck-discharge pump.

Compared with the prior art, the present disclosure has the following beneficial effects:

In the present disclosure, the advanced cutterhead is designed as a small-diameter plane cylinder structure, around which the guide rollers are provided, in order to effectively solve the problem of wellbore deflection of the tilted stratum. Moreover, the muck gathering space is disposed in the inner cavity of the advanced cutterhead, which can solve the problem of high-efficiency muck discharge. The cutter-expanded boring head is designed as the tilted surface cone-shaped structure in the central direction of the shaft, the crushed rock muck is easy to slid down and gather in the space of the advanced cutterhead under a joint action of gravity and hydraulic power, which solves the problem of muck leaving and muck gathering during the tunneling process of the large-section shaft well. This novel cutterhead structure solves the key technical problems of high-efficiency rock-breaking and muck-discharge of the current full-section shaft tunnel boring machine, thereby improving the working efficiency and saving the cost.

In the present disclosure, the formwork positioning assembly and the formwork guide and moving assemblies are adopted to achieve the radial and horizontal movement of the formwork, to accurately control the distance from the formwork to the central line of the wellbore, and to achieve the positioning and fixation of the formwork in the wellbore.

In the present disclosure, according to the characteristic that the small-scale rock muck has a great proportion and the large-scale rock muck has a low proportion during the construction of the full-section tunnel boring machine, after the multi-scale rock muck is vertically lifted to the secondary muck-discharge unit on the hanging scaffold in a short distance by adopting the primary muck-discharge pump, the large-scale rock muck is crushed and ground to the small-scale rock muck through graded crushing, and this small-scale rock muck and the small-scale rock muck that is separated previously are uniformly and directly conveyed to the ground through a high-lift muck-discharge pump. The full-face shaft tunnel boring machine system provided by the present disclosure eliminates the problem that the relay station is hard to be set in the wellbore, and solves the problem of system reliability; the tube plugging problem is effectively solved after the large-scale rock muck is eliminated; the mud circulation is changed to the water circulation such that the energy consumption is greatly reduced; and the muck-discharge system may achieve the high-efficiency and continuous operation, which lays a solid foundation for the intelligent and high-efficiency shaft construction.

BRIEF DESCRIPTION OF THE DRAWINGS

FIG. 1 is divided into three parts for easy show of structures in the present disclosure.

DETAILED DESCRIPTION OF THE EMBODIMENTS

In order to make the objectives, technical solution and advantages of the the present disclosure clearer, the technical solutions in the embodiments of the present disclosure are clearly and completely elaborated below in combination with the embodiments of the present disclosure. It is apparent that the described embodiments are a part of the embodiments of the present disclosure but not all. Based on the embodiments of the present disclosure, all the other embodiments obtained by those of ordinary skill in the art on the premise of not contributing creative effort should belong to the protection scope of the present disclosure.

Figure 5:
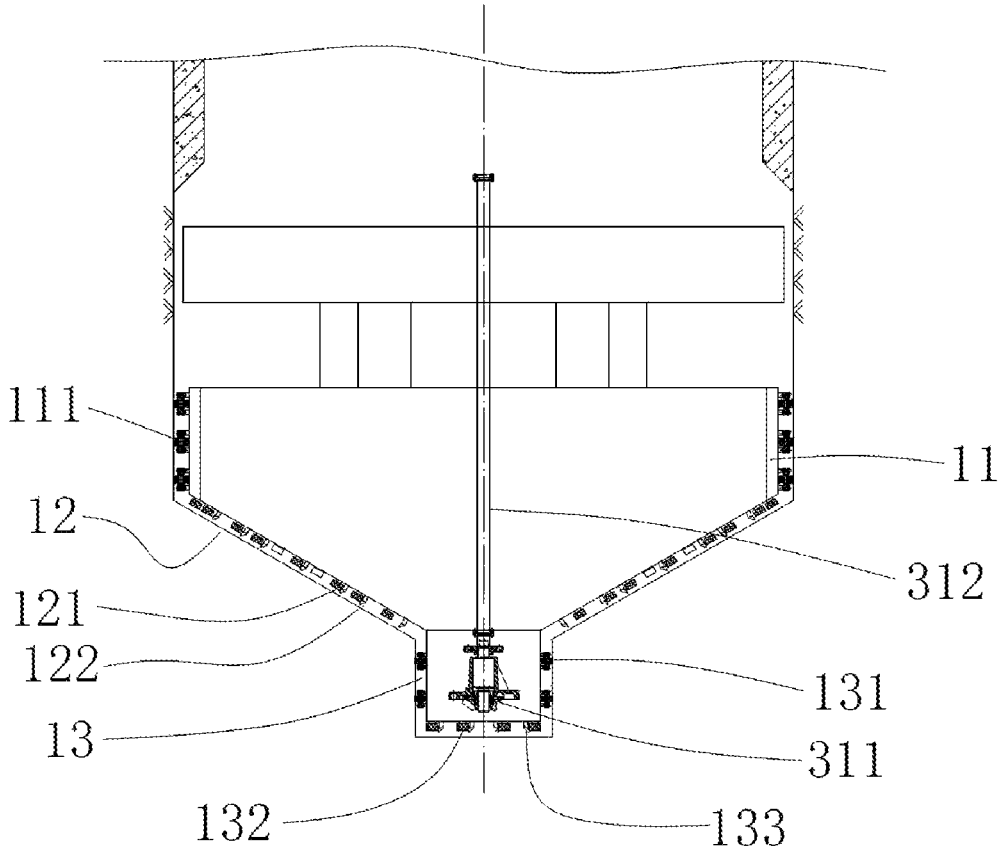
FIG. 5 is a profile diagram that a tunnel boring machine cutterhead device is applied in a shaft in the present disclosure (an enlarged drawing of a part D in FIG. 4).
Figure 6:
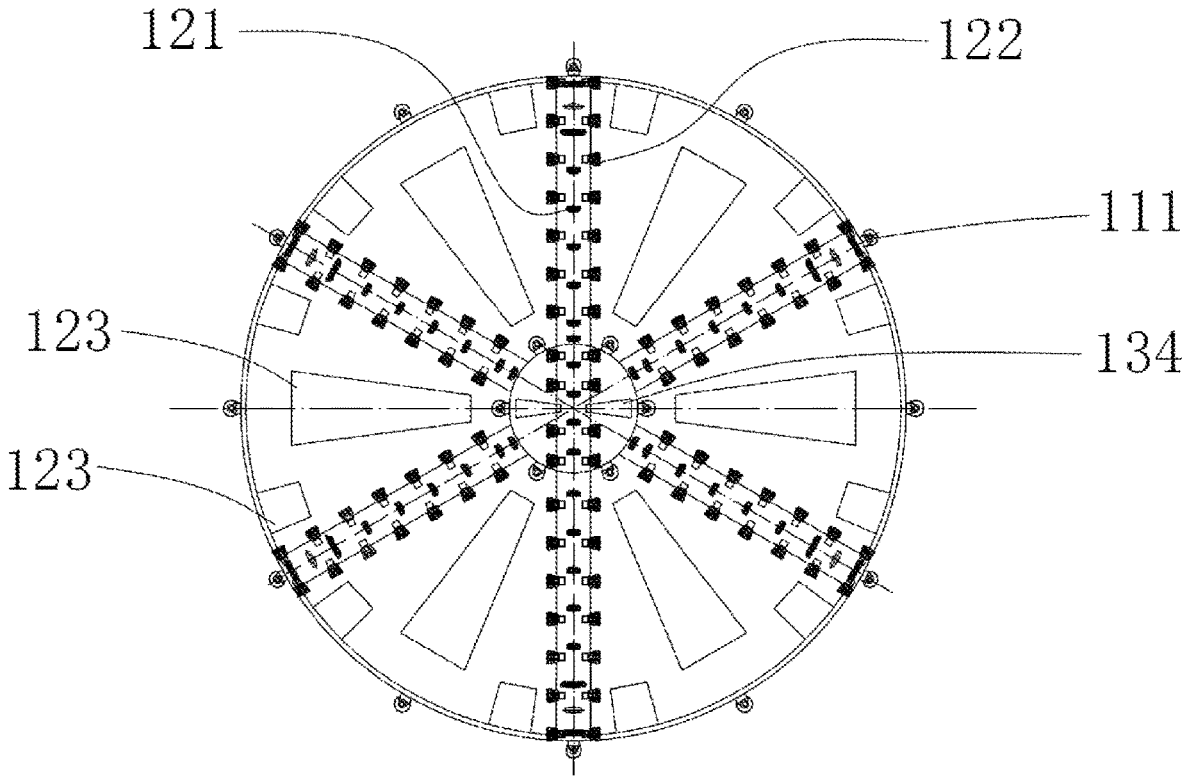
FIG. 6 is a bottom view of FIG. 5.
Figure 7:
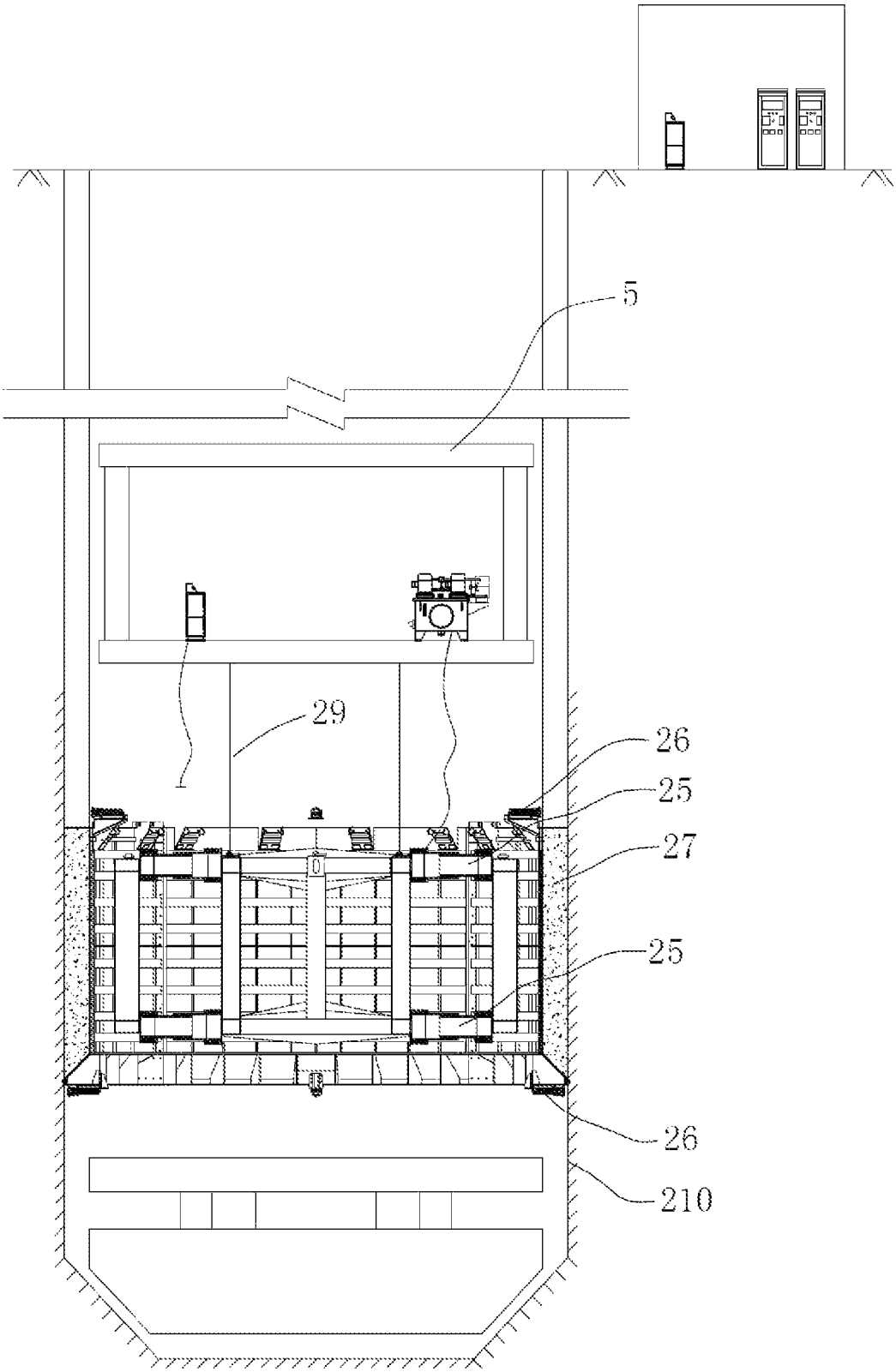
FIG. 7 is a vertical view of a hydraulic formwork for walling a shaft wellbore.
Figure 8:
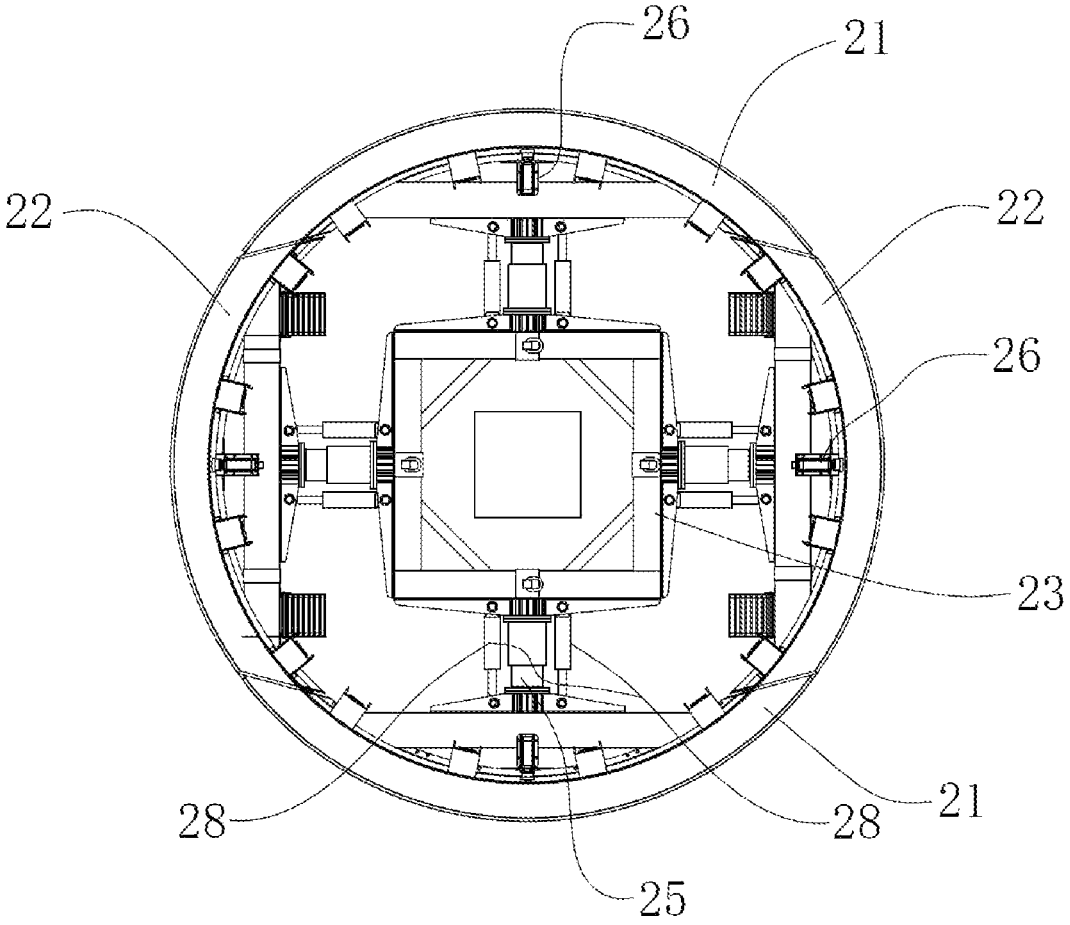
FIG. 8 is a top view of a hydraulic formwork for walling a shaft wellbore.

Embodiments: for easy understanding of the present disclosure, the process and principle that the tunnel boring machine cutterhead in the present disclosure tunnels downwards are first set forth. Referring to FIG. 5 and FIG. 6, the tunnel boring machine cutterhead device includes a vertical guide frame 11, a cutter-expanded boring head 12 and an advanced cutterhead 13 that are fixedly connected from top to bottom so as to form an integrated structure.

The vertical guide frame 11 is a hollow cylindrical profile steel structure, multiple groups of guide rollers are uniformly distributed along a circumference, and the multiple guide rollers contact with the tunneling rock shaft wall to play a vertical guide role; an upper part of the vertical guide frame 11 is connected to a power system through a steel structure such that the whole cutterhead structure is driven to break the rock and tunnel rotationally along a central line of a wellbore; and the power system includes a hydraulic system, an electronic control system, a transmission system and the like, and the hydraulic system, the electronic control system, the transmission system and the like are the current mature technologies, and repetition is not made herein.

In a specific setting, an included angle between an axis of a cone of the cutter-expanded boring head 12 and a slant height is 15-75 degrees, preferably 25-65 degrees. The vertical guide frame 11 and the advanced cutterhead 13 are both hollow cylindrical structures, a diameter ratio of the advanced cutterhead 13 to the vertical guide frame 11 is 1:2-1:6, preferably 1:3-1:5, so that the cutter-expanded boring head 12 falls along a tilted surface until a rock muck amount in an inner cavity of the advanced cutterhead 13 is within the preferred range.

Figure 1:
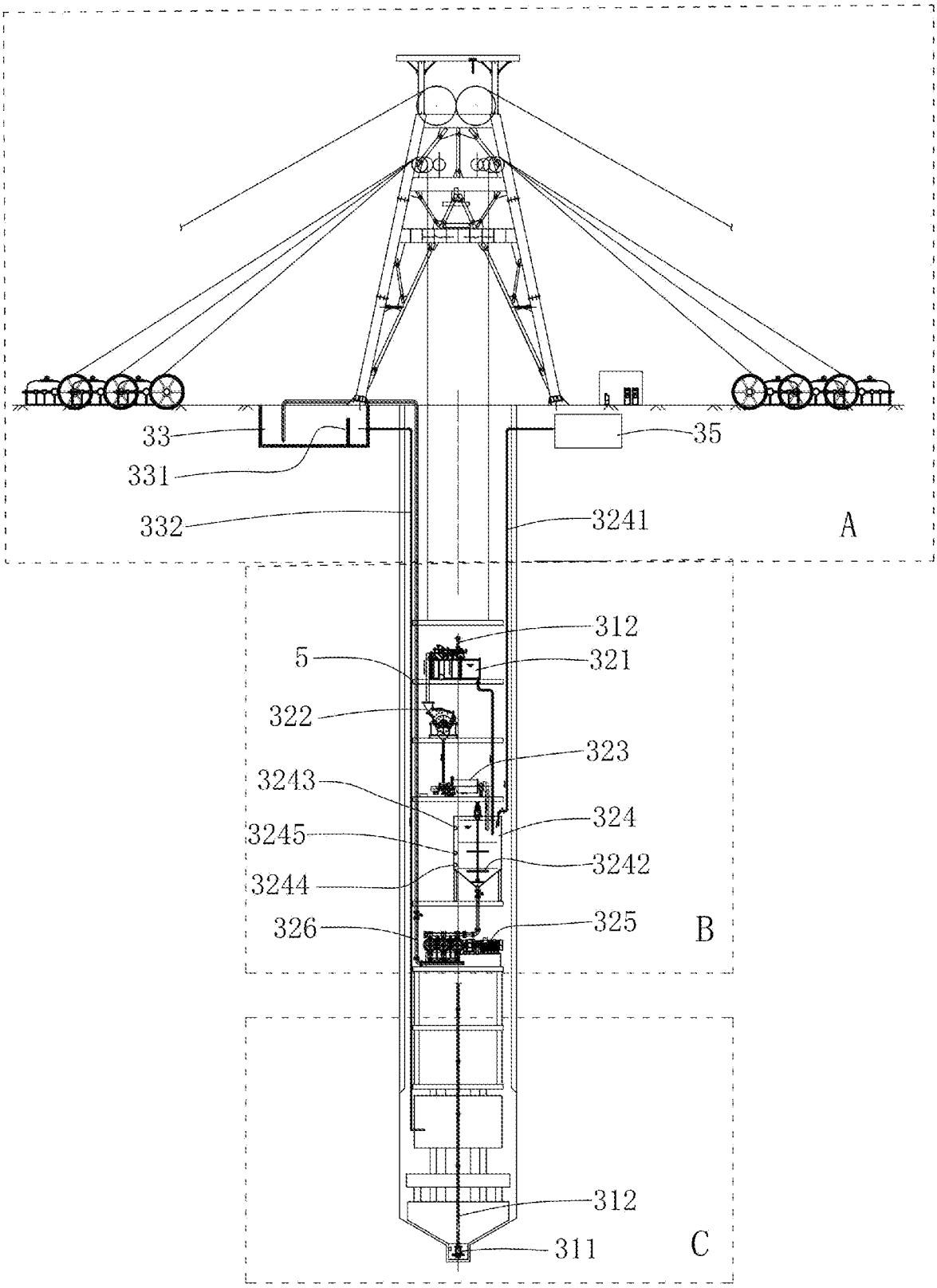
FIG. 1 is an overall structure diagram of the present disclosure; due to a length limitation of A4.
Figure 2:
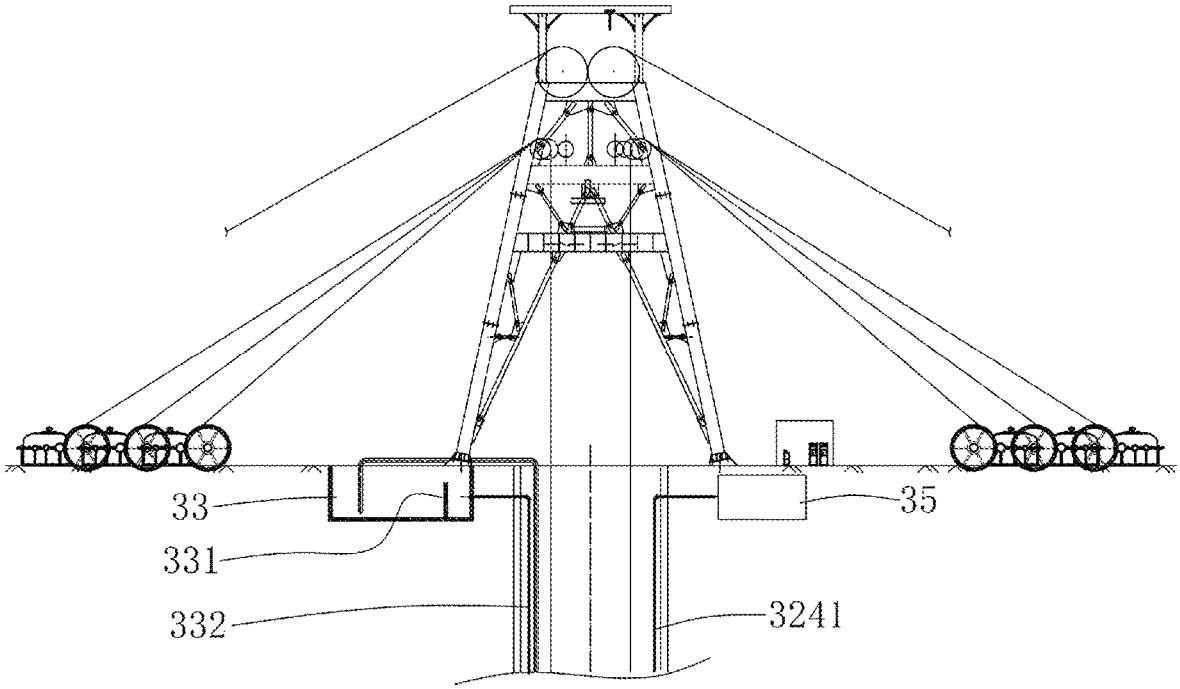
FIGS. 2 to 4 are local drawings of three parts A, B, C in FIG. 1, respectively.
Figure 3:
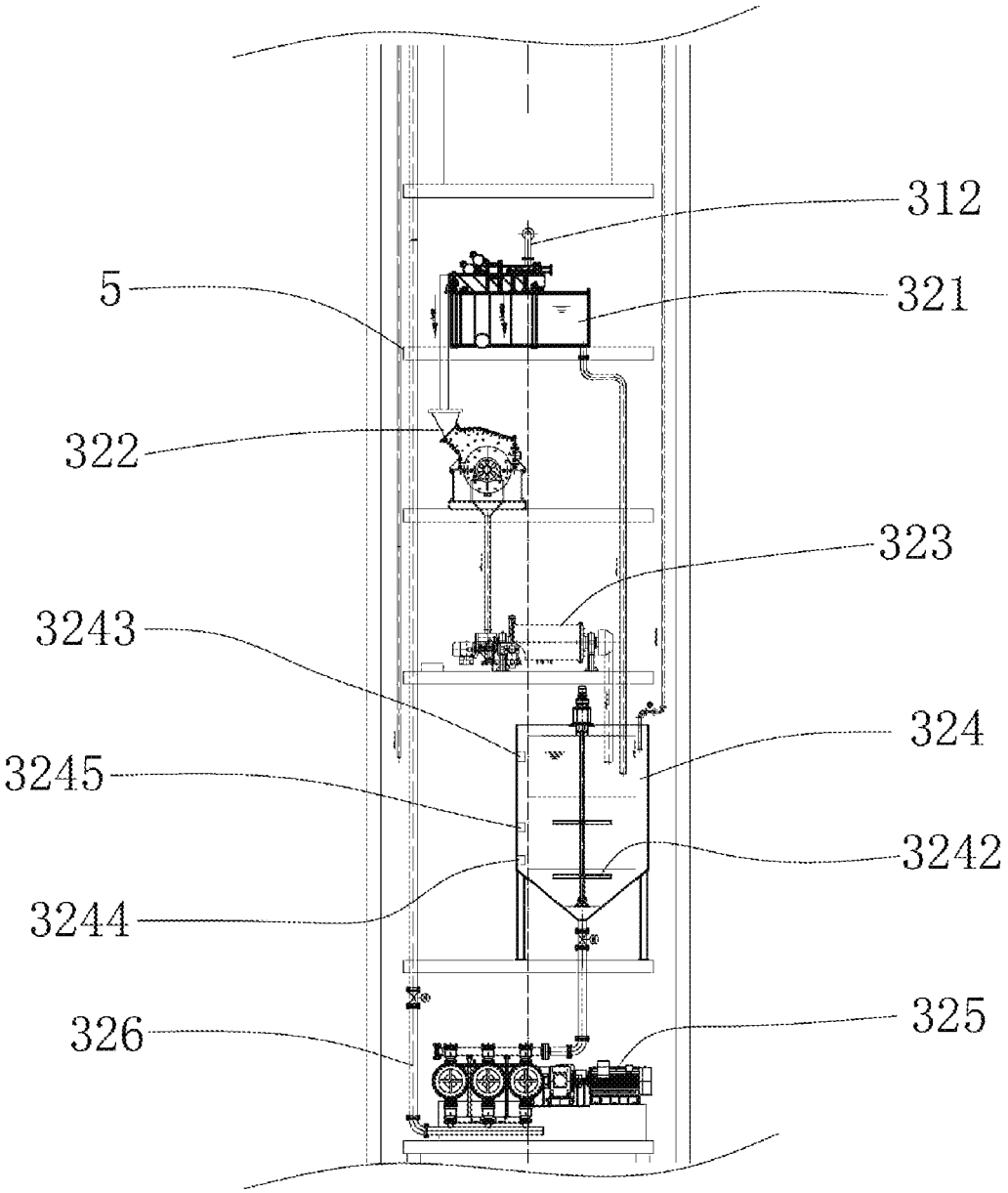
Figure 4:
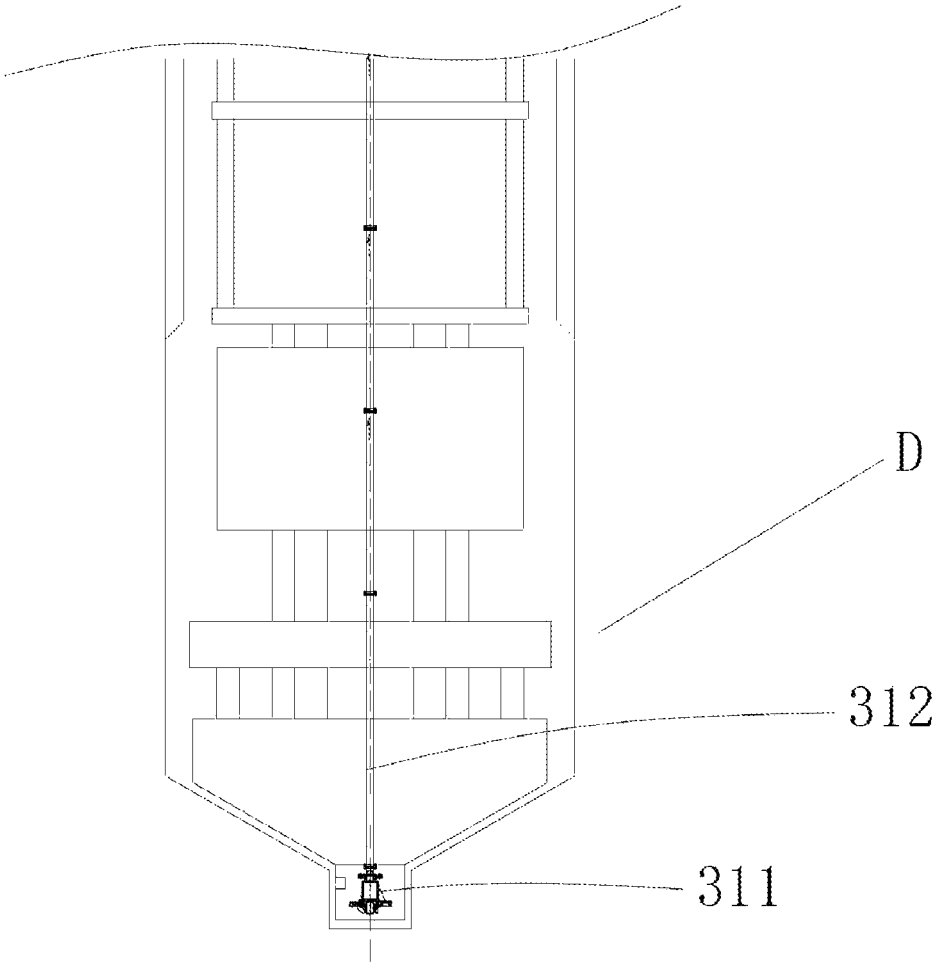

The cutter-expanded boring head 12 is a hollow and cone-shaped rigid structural member, of which an upper part is joined to the vertical guide frame 11 while a lower part is joined to the advanced cutterhead 13; multiple groups of hobbing cutters, scrapers, muck outlets and water holes are uniformly distributed outside the cutter-expanded boring head 12, a vertical and downward pressure is delivered to the cutterhead through the power system and the rock on the working surface is crushed through the rotation and extrusion of the hobbing cutters of the cutter-expanded boring head, the crushed rock muck is stirred and shoveled away through the scrapers and discharged to a cavity tilted surface inside the cutterhead through the muck outlets; and under a joint action of self-gravity and hydraulic scouring, the rock muck accumulates along the tilted surface and slides to the cavity inside the advanced cutterhead 13, and then the rock muck is pumped to the water-muck separating equipment 321 (as shown in FIG. 3) through a primary muck-discharge pump 311 and a secondary muck-discharge pipeline 312.

The advanced cutterhead 13 is a hollow and cylindrical steel structure, of which an upper part is joined to the cutter-expanded boring head 12, multiple groups of guide wheels are uniformly distributed around the advanced cutterhead 13 and contact with a rock wall of an advanced guide hole to play a guide role, and a bottom of the advanced cutterhead 13 is uniformly provided with multiple groups of hobbing cutters and scrapers, muck outlets and water holes; and the vertical and downward pressure is delivered to the cutterhead through the power system and the rock on the working surface is crushed through the rotation and extrusion of the hobbing cutters of the advanced cutterhead 13, and the scrapers stir and shovel away the crushed rock muck through the rotation of the cutterhead. Under the joint action of the force of water flow and the shovel stirring, the rock muck is discharged to the cavity inside the advanced cutterhead.

In a specific setting, the first guide rollers 11 are distributed at intervals along an axis direction of the vertical guide frame 1 so as to constitute one row from top to bottom, and multiple rows of rollers are arranged at equal intervals along a circumferential direction of the vertical guide frame 1, which not only plays a guide role, but also plays a role in reducing a frictional force.

First hobbing cutters 121 and first scrapers 122 are distributed at intervals along a slant height of the cone on a side of the cutter-expanded boring head 12, a plurality of first hobbing cutters 121 and a plurality of first scrapers 122 are respectively distributed in a row, and multiple rows of first hobbing cutters 121 and multiple rows of first scrapers 122 are distributed at equal intervals on the side of the cutter-expanded boring head 12 along a circumferential direction of the cone; first muck outlets 123 are arranged between any two adjacent rows of first shovel blades 122. Further, as shown in FIG. 6, two rows of first scrapers 122 and one row of first hobbing cutters 121 constitute one group of rock-breaking muck shoveling system, multiple groups of rock-breaking muck shoveling systems are distributed at equal intervals on the side of the cutter-expanded boring head 2 along the circumferential direction, and the first muck outlets 123 are arranged between two adjacent groups of rock-breaking muck shoveling systems. In one group of rock-breaking muck shoveling systems, one row of first hobbing cutters 121 is located between the two rows of first scrapers 122, the rock on the working face is shoveled through the first scrapers 122 after being crushed by the first hobbing cutters 121, then the rock falls in the inner cavity of the cutter-expanded boring head 12 through the first muck outlets 123 and finally enters the inner cavity of the advanced cutterhead 13 along the tilted surface of the inner cavity, and then the rock is discharged to the ground through a muck slurry pump and a muck-discharge pipeline 5.

On a circumferential surface of the advanced cutterhead 13, the second guide rollers 131 are distributed at intervals along an axis of the advanced cutterhead 13 so as to constitute one row from top to bottom, and multiple rows of rollers are arranged at equal intervals along a circumferential direction of the advanced cutterhead 13 and contact with a rock wall of an advanced guide hole, in order to play a guide role and a role in reducing a frictional force.

At least one row of second hobbing cutters 132 and two rows of scrapers blades 133, located on two sides of the second hobbing cutters 132, are arranged on a bottom face of the advanced cutterhead 13; second muck outlets 134 and the rowed second hobbing cutters 132/second scrapers 133 are crossly disposed in a circumferential direction of the advanced cutterhead 13; the rock at the bottom face of the advanced guide hole is crushed through the second hobbing cutters 132 during a rotating process, shoveled through the second scrapers 133, enters the inner cavity of the advanced cutterhead 13 through the second muck outlets 134, and pumped to water-muck separating equipment 321 through a primary muck-discharge pump 311 and a primary muck-discharge pipeline 312.

Figure 9:
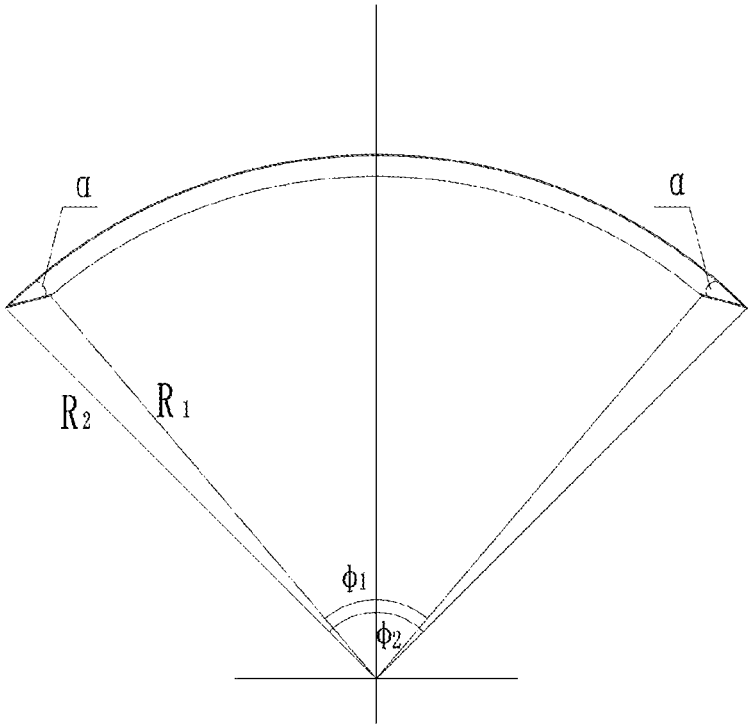
FIG. 9 is a diagram of an outer formwork.
Figure 10:
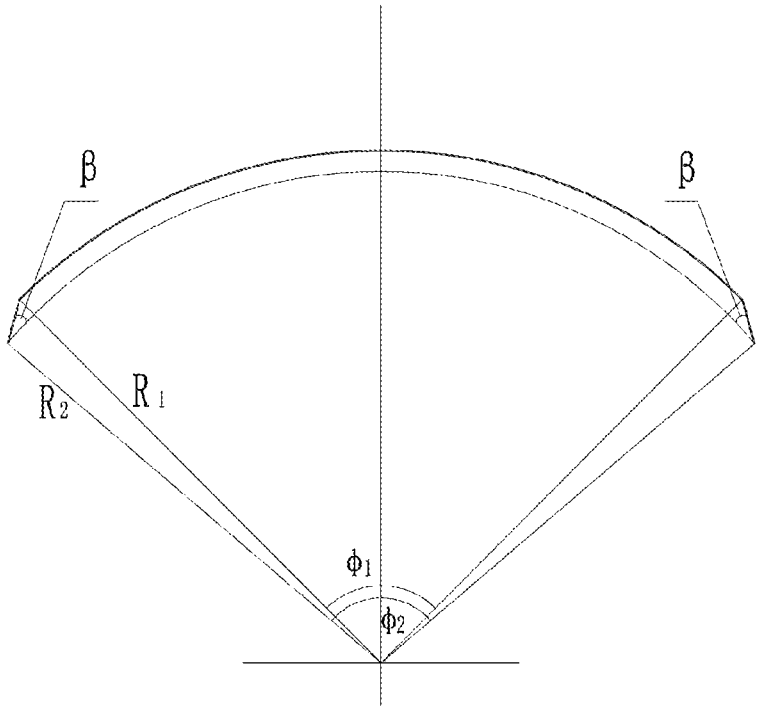
FIG. 10 is a diagram of an inner formwork.
Figure 11:
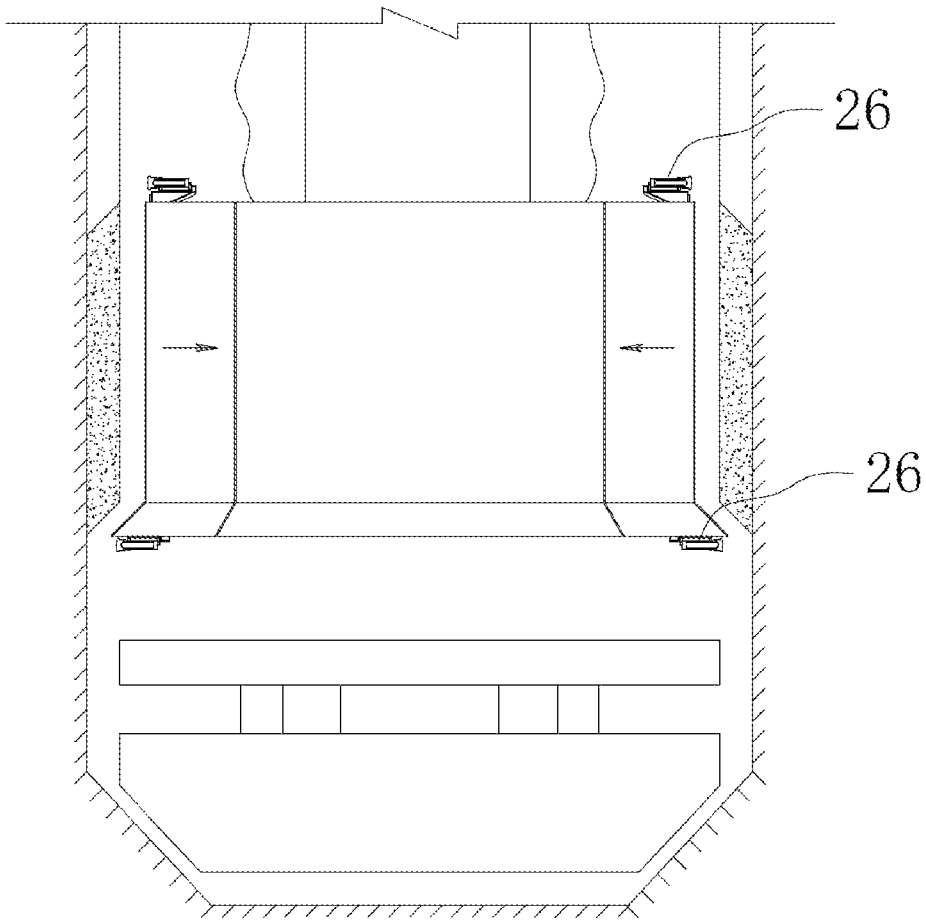
FIG. 11 is a vertical view that a formwork is separated from a shaft wall.
Figure 12:
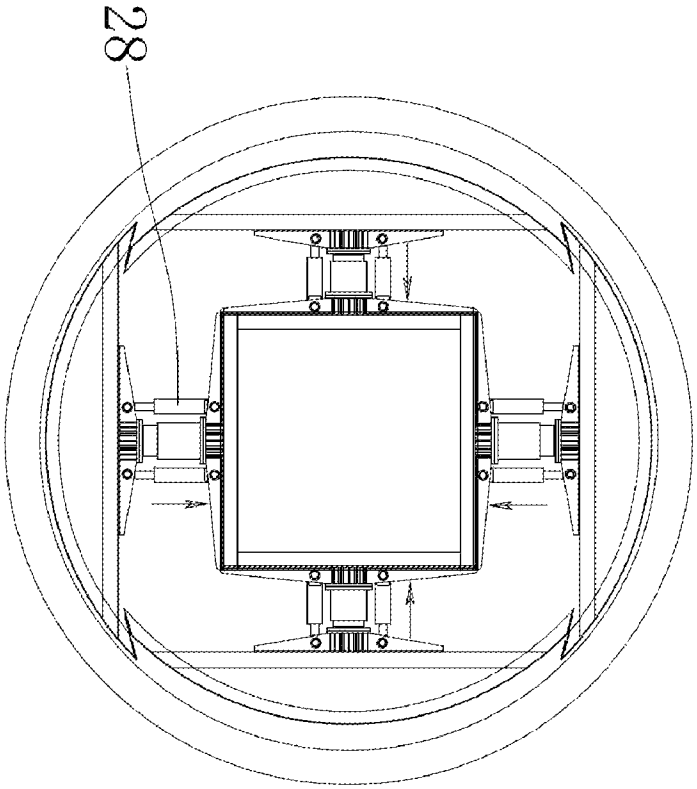
FIG. 12 is a plan view that a formwork is separated from a shaft wall.
Figure 13:
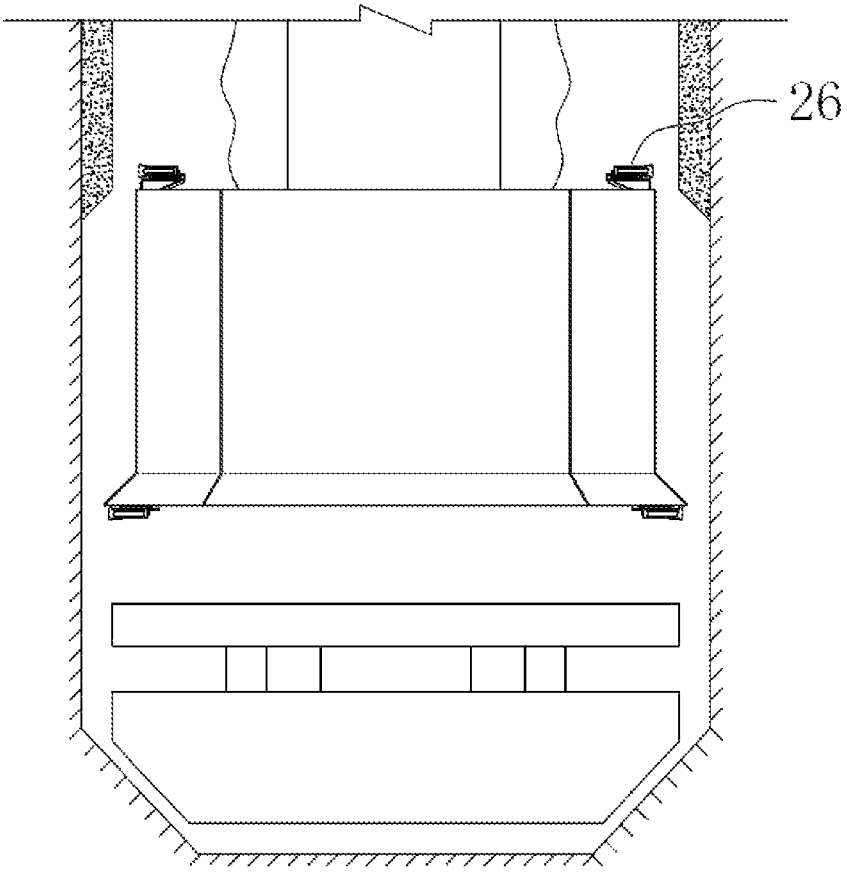
FIG. 13 is a vertical view when a formwork is moved downwards.
Figure 14:
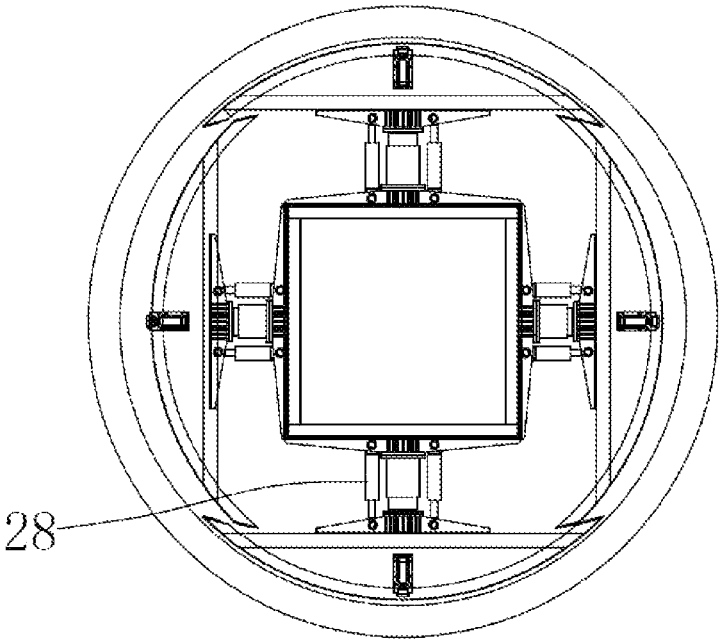
FIG. 14 is a plan view when a formwork is moved downwards.
Figure 15:
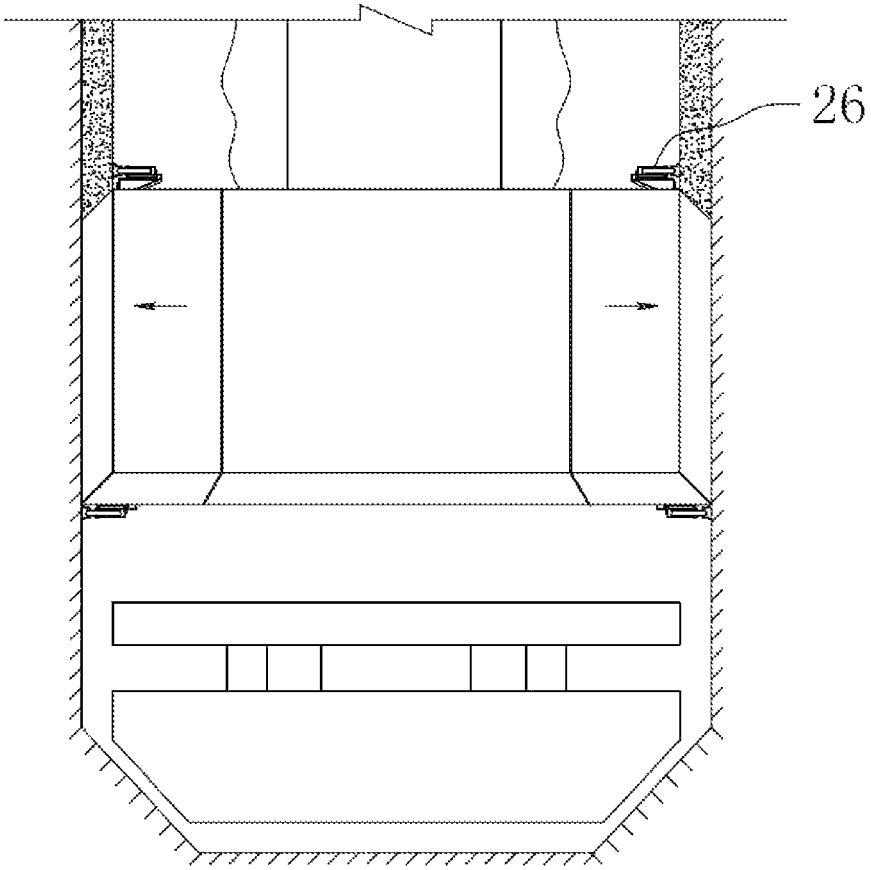
FIG. 15 is a vertical view for secondary positioning and fixation of a formwork.
Figure 16:
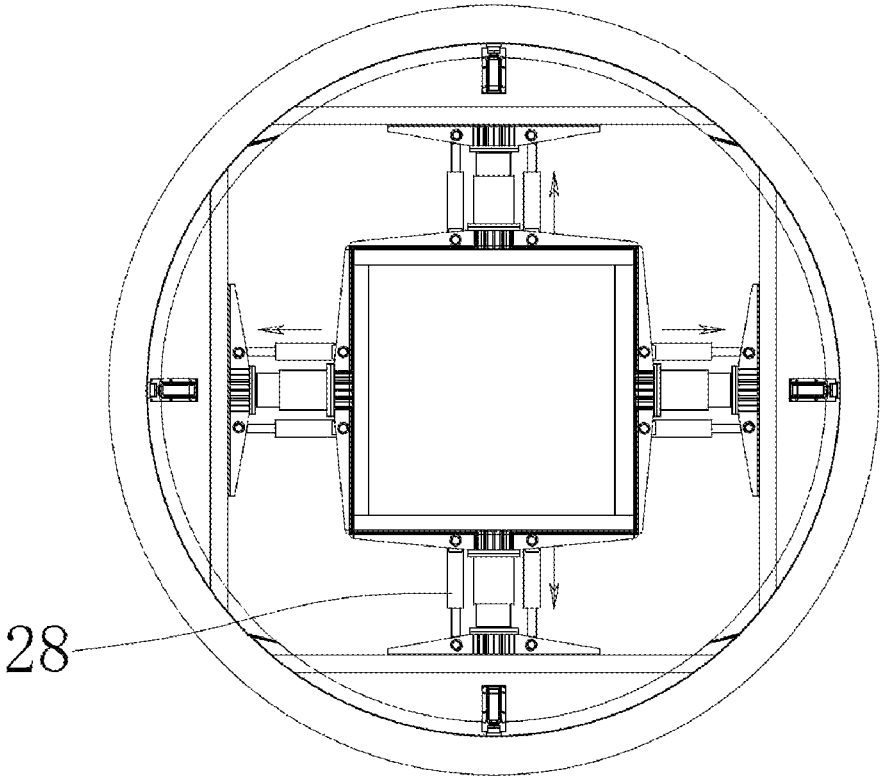
FIG. 16 is a plan view for secondary positioning and fixation of a formwork.
Figure 17:
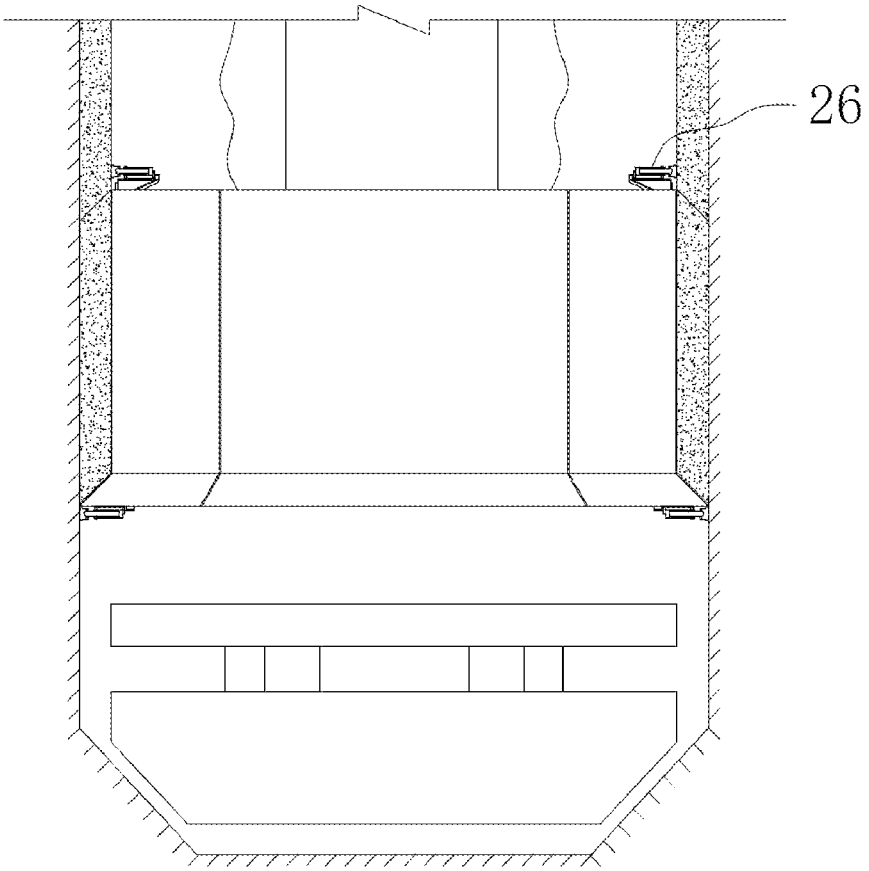
FIG. 17 is a vertical view of secondary walling.
Figure 18:
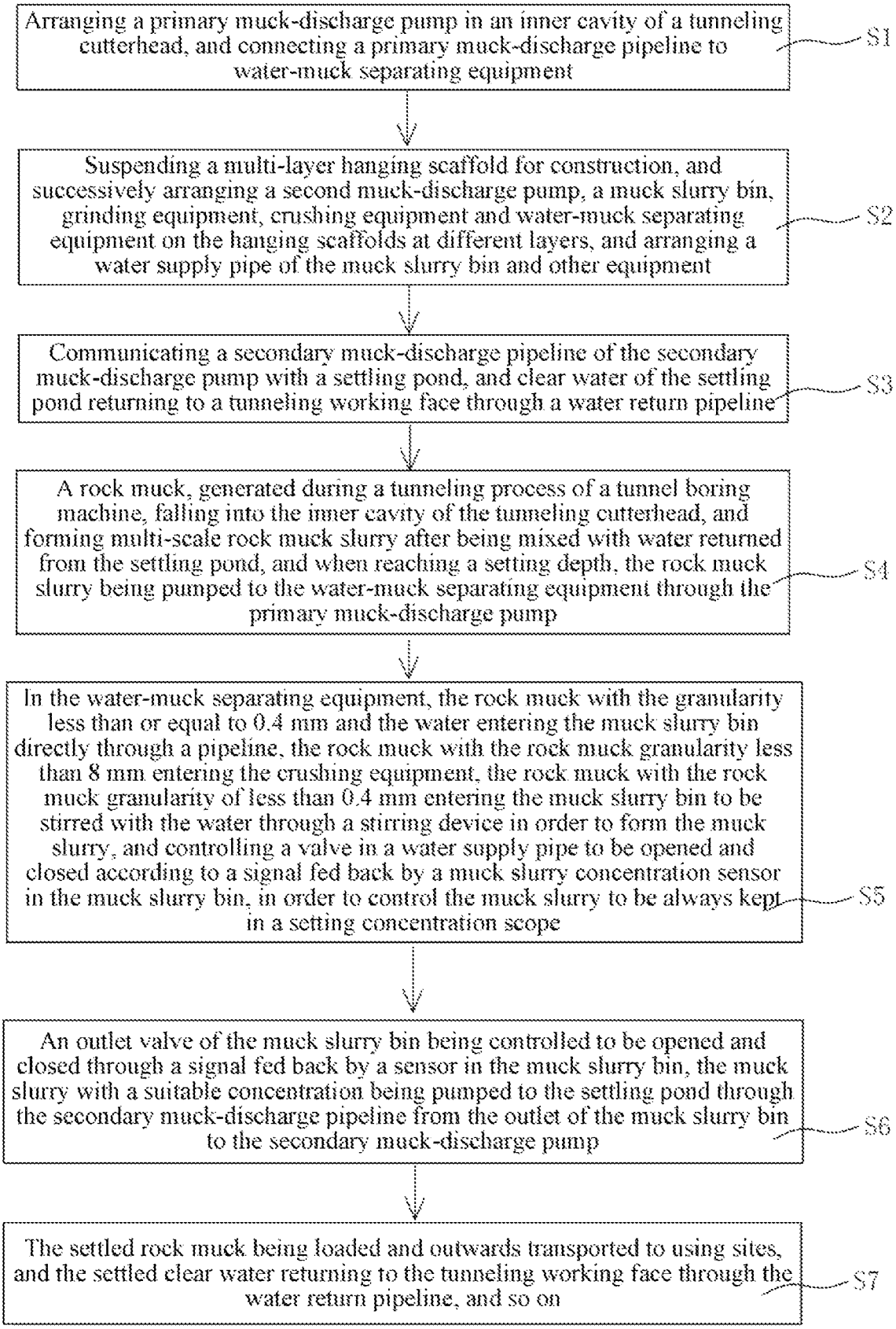
FIG. 18 is a workflow chart of a muck-discharge method for a tunneling system in the present disclosure.

When tunneling downwards, referring to FIGS. 7 to 17, a full-hydraulic formwork system performs supporting and walling on a wellbore shaft wall formed through tunneling, and this full-hydraulic formwork device includes:

a formwork, which is divided into an outer formwork 21 and an inner formwork 22, the outer formwork 21 is an arc-shaped steel structure, of which an outer side is a steel plate and an inner side is a profile steel composite structure, two ends of the outer formwork are tilted surface structures, as shown in FIG. 9, and an included angle $\alpha$ between the tilted surface and the outer side is 15-45 degrees, preferably 25-45 degrees. A central angle of an outer arc $\varphi 2$ is greater than a central angle of an inner arc $\varphi 1$. The inner formwork is an arc-shaped steel structure, of which an outer side is a steel plate and an inner side is a profile steel composite structure, two ends of the inner formwork are tilted surface structures, and as shown in FIG. 10, an included angle $\beta$ between the tilted surface and the inner side is 15-45 degrees, preferably 25-45 degrees. A central angle of an outer arc φ2 is less than a central angle of an inner arc φ1. The outer formwork may also be referred to as "first formwork", and the inner formwork may also be referred to as "second formwork."

A formwork support structure 23, which is a cylindrical profile steel composite structure and suspended at a lower part of a hanging scaffold 5 at an upper part thereof; specifically, a plurality of suspending points are uniformly distributed around an exterior of the formwork support structure, and suspended at the lower part of the hanging scaffold 5 that is at the upper part of the formwork support structure through steel wire ropes 29; and a cross section of the formwork support structure is square, and outer walls of the four sides of the formwork support structure are all connected to formwork guide and moving assemblies.

One end of each of the formwork guide and moving assemblies 25 is connected to the formwork support structure 23 while the other end is connected to the formwork, and the formwork guide and moving assemblies 25 can stretch in order to achieve a radial horizontal displacement of the formwork in the wellbore. Specifically, each formwork guide and moving assembly is a double-layer cylindrical steel structure, an inner cylinder and an outer cylinder are sleeved and can displace relatively along an axis, an end part of the outer cylinder is connected to the formwork support structure through a first flange, and an end part of the inner cylinder is connected to the inner formwork and the outer formwork through a second flange; and at least two groups of hydraulic oil cylinders 28 are disposed outside the outer cylinder, and two ends of the hydraulic oil cylinders are connected to the first flange and the second flange, respectively.

In this embodiment, the shaft walling full-hydraulic formwork device further includes a formwork positioning assembly 26, which includes a steel structure support beam connected to the inner formwork and the outer formwork in a vertical direction, and a telescopic oil cylinder connected to the support beam; the telescopic oil cylinder is disposed along a horizontal direction, an upper end and a lower end of each group of inner formwork and outer formwork are each provided with at least one group of telescopic oil cylinders, an inner side end of each telescopic oil cylinder is connected to the support beam while an outer side end is provided with a supporting shoe, the supporting shoe of the telescopic oil cylinder at the lower end of the formwork contacts with a tunneling rock shaft wall 210, and the supporting shoe of the telescopic oil cylinder at the upper end of the formwork contacts with a poured concrete shaft wall 27.

When tunneling downwards, the rock muck is discharged in time through a muck-discharge system. Referring to FIGS. 1 to 4, the muck-discharge system in the present disclosure includes a primary muck-discharge unit, a secondary muck-discharge unit and a control system.

The primary muck-discharge unit includes a primary muck-discharge pump 311 and a primary muck-discharge pipeline 312, the primary muck-discharge pump 311 is arranged in the inner cavity of the advanced cutterhead 13, and multi-scale rock muck and water are discharged upwards to the secondary muck-discharge unit through the primary muck-discharge pipeline 312.

The secondary muck-discharge unit includes water-muck separating equipment 321, crushing equipment 322, grinding equipment 323, a muck slurry bin 324 and a secondary muck-discharge pump 325 which are arranged from top to bottom; and each piece of equipment may be disposed on the multi-layer hanging scaffold in the wellbore.

An inlet of the water-muck separating equipment 321 communicates with the primary muck-discharge pipeline 312, a rock muck outlet communicates to the crushing equipment and a water outlet (a fine muck outlet) communicates to the muck slurry bin 324; an inlet of the grinding equipment 323 communicates with the rock muck outlet of the water-muck separating equipment, and an outlet of the grinding equipment 323 communicates with the muck slurry bin 324; and a muck slurry in the muck slurry bin 324 is pumped to the ground through the secondary muck-discharge pump 325.

In a specific application, a settling pond 33 is disposed on the ground, the secondary muck-discharge pipeline 326 of the secondary muck-discharge pump 325 communicates with the settling pond 33, partitions 331 are disposed in the settling pond 33, and clear water passed partition returns to the tunneling working face through a water return pipeline 332 for recycling.

In order to make the muck slurry in the muck slurry bin be in a suitable concentration, the muck slurry bin 324 further communicates with a water supply pipe 3241, and a stirring device 3242, a high-level sensor 3243, a low-level sensor 3244 and a muck slurry concentration sensor 3245 are also disposed in the muck slurry bin 324; and each sensor and an electromagnetic valve for controlling the water supply pipe 3241 to be opened and closed are both electrically connected to the control system. A water source 35 is connected to the upper end of the water supply pipe 3241.

The working process and the working method of the muck-discharge system generally include the following steps, and some conventional construction steps are omitted and not repeated herein.

S1: arranging the primary muck-discharge pump 311 in the inner cavity of the tunneling cutterhead of the tunnel boring machine, and connecting the primary muck-discharge pipeline 312 to a place where the water-muck separating equipment 3321 is located.

S2: suspending the multi-layer hanging scaffold 5 for construction in the tunneling wellbore, successively arranging the second muck-discharge pump 325, the muck slurry bin 324, the grinding equipment 323, the crushing equipment 322 and the water-muck separating equipment 321 on the hanging scaffolds at different layers from bottom to top, arranging the water supply pipe 3241 of the muck slurry bin 324 and other equipment, connecting corresponding pipelines and installing adaptive valves, connecting inlets and outlets among equipment, and other preparatory work.

S3: communicating the secondary muck-discharge pipeline 326 of the secondary muck-discharge pump 325 with the settling pond 33, and the clear water of the settling pond 33 returning to the tunneling working face through the water return pipeline 332.

S4: the rock muck, generated during the tunneling process of the tunnel boring machine, falling into the inner cavity of the tunneling cutterhead, and forming the multi-scale rock muck slurry after being mixed with the water returned from the settling pond, and when reaching a certain setting depth, the rock muck slurry being pumped to the water-muck separating equipment 321 through the primary muck-discharge pump 311.

S5: in the water-muck separating equipment 321, the rock muck with the granularity less than or equal to 0.4 mm and the water entering the muck slurry bin 324 directly through the pipeline, the large-scale rock muck entering the crushing equipment 322, the crushed rock muck with the rock muck granularity of less than 8 mm entering the grinding equipment 323, the ground rock muck with the rock muck granularity of less than 0.4 mm entering the muck slurry bin 324 to be stirred with the water, supplied by the water supply pipe 3241, in the muck slurry bin through the stirring device 3242 in order to form the muck slurry, controlling the valve in the water supply pipe 3241 to be opened and closed according to a signal fed back by the muck slurry concentration sensor 3245 in the muck slurry bin, in order to control the muck slurry to be always kept in a setting concentration scope.

S6: the outlet valve of the muck slurry bin 324 being controlled to be opened and closed through the signal fed back by the high-level sensor 3243 and the low-level sensor 3244 in the muck slurry bin 324, the muck slurry with the suitable concentration being pumped to the settling pond 33 through the secondary muck-discharge pipeline 326 from the outlet of the muck slurry bin to the secondary muck-discharge pump 325.

S7: the settled rock muck being loaded and outwards transported to using sites, and the settled clear water returning to the tunneling working face through the water return pipeline 332, and so on.

A sinking headframe is installed on the construction wellbore ground, and a multi-layer platform and a plurality of head sheaves are disposed on the headframe. The hoisting winch and the suspension winch are joined to the multi-layer hanging scaffold, the pipeline and the tunnel boring machine equipment through the steel wire ropes and around the head sheaves. The ground is installed with the hoisting winch, which is responsible for up and down transportation of personnel, materials and equipment, and at the same time, multiple sets of suspension winches are installed and responsible for vertical up and down movement of the multi-layer hanging scaffold and accessory equipment in the wellbore. A centralized control center is disposed on the ground, the control system therein is connected to each equipment, pump, valve, sensor and the like through control cables, in order to control the muck-discharge system to achieve full-automatic continuous operation, thereby achieving unattended operation.

It should be noted that the part not set forth in detail in the present disclosure belongs to the general common technology in the field or may be acquired by purchasing from the market directly without contributing creative labor by those skilled in the art, and the specific connection mode thereof has an extremely wide range of application in the field or daily life, and detail description is not made herein.

In addition, without conflicting, those skilled in the art may combine and assemble different embodiments or examples and the characteristics of the different embodiments or examples. Although the embodiments of the present disclosure have been shown and described above, it is understood that the above embodiments are exemplary instead of being understood as a limitation to the present disclosure. Those of ordinary skill in the art may make change, modification, replacement and deformation to the above embodiments within the scope of the present disclosure.

What is claimed is:

1. A full-face shaft tunnel boring machine system, comprising:

a tunnel boring machine cutterhead device for tunneling downwards in a shaft;

a full-hydraulic formwork device for supporting and walling in a wellbore; and an upper muck-discharge system for vertically conveying rock mucks generated by tunneling; wherein the tunnel boring machine cutterhead device comprises, in vertical order from top to bottom and fixedly connected so as to form an integrated structure, a vertical guide frame, a cutter-expanded boring head and an advanced cutterhead;

the vertical guide frame is a hollow cylindrical structure and driven to rotate around an axis of the vertical guide frame by a power mechanism, and an outer wall of the vertical guide frame is provided with multiple sets of first guide rollers;

the cutter-expanded boring head is a hollow cone-shaped structure, and an outer wall of the cutter-expanded boring head is provided with multiple sets of first hobbing cutters and first scrapers, first muck outlets and water holes;

the advanced cutterhead is a hollow cylindrical structure, a circumferential surface of an outer wall of the advanced cutterhead is provided with multiple sets of second guide rollers, and a bottom of the advanced cutterhead is provided with multiple sets of second hobbing cutters and second scrapers, second muck outlets and blowholes water holes;

a primary muck-discharge pump is arranged in an inner cavity of the advanced cutterhead;

the full-hydraulic formwork device comprises a first formwork, a second formwork, a formwork support structure, and formwork guide and moving assemblies;

the formwork support structure is a cylindrical, steel, composite structure and suspended on a lower part of a hanging scaffold that is on an upper part of the formwork support structure;

the formwork guide and moving assemblies are divided into four groups and symmetrically disposed in pairs, one end of each of two groups is connected to the formwork support structure while the other end is connected to the second formwork, and one end of each of the other two groups is connected to the formwork support structure while the other end is connected to the first formwork; the formwork guide and moving assemblies are capable of stretching in order to achieve a radial horizontal displacement of the formwork in the wellbore;

the upper muck-discharge system comprises a primary muck-discharge unit, a secondary muck-discharge unit and a control system;

the primary muck-discharge unit comprises a primary muck-discharge pump and a primary muck-discharge pipeline, the primary muck-discharge pump is arranged in the inner cavity of the advanced cutterhead, and multi-scale rock mucks and water are discharged upwards to the secondary muck-discharge unit through the primary muck-discharge pipeline;

the secondary muck-discharge unit comprises water-muck separating equipment, crushing equipment, grinding equipment, a muck slurry bin and a secondary muck-discharge pump which are arranged in a vertical order from top to bottom;

an inlet of the water-muck separating equipment communicates with the primary muck-discharge pipeline, a rock muck outlet communicates to the crushing equipment, and a water outlet communicates to the muck slurry bin;

an inlet of the grinding equipment communicates with the rock muck outlet of the water-muck separating equipment, and an outlet of the grinding equipment communicates with the muck slurry bin; and a muck slurry in the muck slurry bin is pumped to the ground through the secondary muck-discharge pump.

2. The full-face shaft tunnel boring machine system according to claim 1, wherein the first guide rollers are distributed at intervals along an axis direction of the vertical guide frame so as to constitute one row from top to bottom, and multiple rows of rollers are arranged at equal intervals along a circumferential direction of the vertical guide frame;

on a circumferential surface of the advanced cutterhead, the second guide rollers are distributed at intervals along an axis of the advanced cutterhead so as to constitute one row from top to bottom, and multiple rows of rollers are arranged at equal intervals along a circumferential direction of the advanced cutterhead;

on a side of the cutter-expanded boring head, the first hobbing cutters and the first scrapers are distributed at intervals along a slant height of a cone, multiple first hobbing cutters and multiple first scrapers are each distributed in a row, multiple rows of first hobbing cutters and multiple rows of first scrapers are distributed at equal intervals on the side of the cutter-expanded boring head along the circumferential direction of the cone, and a first muck outlet is disposed between any two adjacent rows of first scrapers;

at least one row of second hobbing cutters, and two rows of second scrapers that are located on both sides of the second hobbing cutters are arranged on a bottom face of the advanced cutterhead; and second muck outlets and the second hobbing cutters or the second scrapers are alternately arranged in the circumferential direction of the advanced cutterhead; and the vertical guide frame and the advanced cutterhead are both hollow cylindrical structures, and a diameter ratio of the advanced cutterhead to the vertical guide frame is in the range of 1:2-1:6.

3. The full-face shaft tunnel boring machine system according to claim 2, wherein two rows of first scrapers and one row of first hobbing cutters constitute a group of rock-breaking and muck-shoveling system, multiple groups of rock-breaking and muck-shoveling systems are distributed at equal intervals on the side of the cutter-expanded boring head along the circumferential direction, the first muck outlet is disposed between two adjacent rock-breaking and muck-shoveling systems, and one row of the first hobbing cutters is located between the two rows of first scrapers, in any one group of rock-breaking and muck-shoveling systems.

4. The full-face shaft tunnel boring machine system according to claim 3, wherein the cutter-expanded boring head is a hollow cone, and an included angle between the axis of the cone and the slant height is 15-75 degrees.

5. The full-face shaft tunnel boring machine system according to claim 1, wherein the shaft walling full-hydraulic formwork device further comprises a formwork positioning assembly, which comprises a steel structure support beam connected to the second formwork and the first formwork in a vertical direction, and a telescopic oil cylinder connected to the support beam; the telescopic oil cylinder is disposed along a horizontal direction, an upper end and a lower end of each group of second formwork and first formwork are each provided with at least one group of telescopic oil cylinders, an inner side end of each telescopic oil cylinder is connected to the support beam while an outer side end is provided with a supporting shoe, the supporting shoe of the telescopic oil cylinder at a lower end of the formwork contacts with a tunneling rock shaft wall, and the supporting shoe of the telescopic oil cylinder at an upper end of the formwork contacts with a poured concrete shaft wall; and a plurality of suspending points are uniformly distributed around an exterior of the formwork support structure, and suspended at a lower part of the hanging scaffold that is at an upper part of the formwork support structure through the steel wire ropes; and a cross section of the formwork support structure is square, and outer walls of the four sides of the formwork support structure are all connected to the formwork guide and moving assemblies.

6. The full-face shaft tunnel boring machine system according to claim 1, wherein a settling pond is disposed on the ground, a secondary muck-discharge pipeline of the secondary muck-discharge pump communicates with the settling pond, partitions are disposed in the settling pond, and after the partitions, clear water returns to a tunneling working face through a water return pipeline for recycling.

7. The full-face shaft tunnel boring machine system according to claim 1, wherein the muck slurry bin further communicates with a water supply pipe, and a stirring device, a high-level sensor, a low-level sensor and a muck slurry concentration sensor are also disposed in the muck slurry bin; and each sensor and an electromagnetic valve for controlling the water supply pipe to be opened and closed are both electrically connected to the control system.

8. The full-face shaft tunnel boring machine system according to claim 1, wherein in the water-muck separating equipment, the rock muck with a granularity of less than or equal to 0.4 mm directly enters the muck slurry bin together with the water through the pipeline; and in the crushing equipment, the crushed rock muck with a granularity of less than 8 mm enters the grinding equipment.

9. The full-face shaft tunnel boring machine system according to claim 8, wherein in the grinding equipment, the ground rock muck with a granularity of less than 0.4 mm enters the muck slurry bin, and the muck slurry, formed after being stirred, is pumped to the settling pond through the secondary muck-discharge pump.

* * * * *